US007789494B2

(12) United States Patent
Hong et al.

(10) Patent No.: US 7,789,494 B2
(45) Date of Patent: Sep. 7, 2010

(54) INKJET HEAD INCLUDING PLURALITY OF RESTRICTORS TO RESTRAIN CROSSTALK

(75) Inventors: Young-ki Hong, Anyang-si (KR); Tae-kyung Lee, Suwon-si (KR); Jae-woo Chung, Yongin-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 473 days.

(21) Appl. No.: 11/767,655

(22) Filed: Jun. 25, 2007

(65) Prior Publication Data

US 2008/0143796 A1 Jun. 19, 2008

(30) Foreign Application Priority Data

Dec. 13, 2006 (KR) ..... 10-2006-0127194

(51) Int. Cl.
*B41J 2/045* (2006.01)

(52) U.S. Cl. ..... 347/68; 347/65; 347/94; 347/70

(58) Field of Classification Search ..... 347/20, 347/44, 47, 56, 61–65, 68, 70–72, 92–94
See application file for complete search history.

(56) References Cited

U.S. PATENT DOCUMENTS 5,793,393 A * 8/1998 Coven ..... 347/65
6,955,418 B2 * 10/2005 Ito ..... 347/68
2003/0112300 A1 6/2003 Chung et al.

FOREIGN PATENT DOCUMENTS

KR 2003-50477 6/2003

* cited by examiner

*Primary Examiner*—Juanita D Stephens
(74) *Attorney, Agent, or Firm*—Stanzione & Kim LLP

(57) ABSTRACT

An inkjet head including a plurality of restrictors to reduce crosstalk. The inkjet head includes a channel plate in which an ink channel is formed, an actuator formed on the channel plate, and an ink-supply bezel including a manifold. The ink channel includes an ink inlet to receive ink from the manifold, reservoirs to store ink received through the ink inlet, chambers filled with ink supplied from the reservoirs, nozzles to eject ink filled in the chambers, first restrictors connecting the reservoirs to the chambers, and second restrictors connecting the reservoirs to the ink inlet. Each of the reservoirs includes a first reservoir and a second reservoir that are separated by a central separation wall, and the separation wall includes a third restrictor connecting the first and second reservoirs. Therefore, crosstalk caused by a back flow of ink and transmission of a pressure wave can be prevented during ejection of ink.

27 Claims, 9 Drawing Sheets

INKJET HEAD INCLUDING PLURALITY OF RESTRICTORS TO RESTRAIN CROSSTALK

CROSS-REFERENCE TO RELATED APPLICATIONS

This application claims the benefit of Korean Patent Application No. 10-2006-0127194, filed on Dec. 13, 2006, in the Korean Intellectual Property Office, the disclosure of which is incorporated herein in its entirety by reference.

BACKGROUND OF THE INVENTION

1. Field of the Invention

The present general inventive concept relates to a piezoelectric inkjet head, and more particularly, to a piezoelectric inkjet head including a plurality of restrictors to restrain crosstalk.

2. Description of the Related Art

Inkjet heads are devices used to form color images on printing mediums by firing droplets of ink onto a desired region of a corresponding printing medium. Inkjet heads can be classified into two types, which are thermal inkjet heads and piezoelectric inkjet heads, depending on the used ink ejecting method. The thermal inkjet head generates ink bubbles by using heat and ejects the ink by utilizing the expansion of the bubbles, and the piezoelectric inkjet head ejects ink using a pressure generated by deforming a piezoelectric material.

FIG. 1 is a cross-sectional diagram schematically illustrating a general structure of a conventional piezoelectric inkjet head. Referring to FIG. 1, a manifold 2, a restrictor 3, a pressure chamber 4, and a nozzle 5 are formed in a channel plate 1 to form an ink channel, and a piezoelectric actuator 6 is disposed on the channel plate 1. The manifold 2 is a common passage through which ink is supplied from an ink tank (not illustrated) to pressure chambers such as the pressure chamber 4. The restrictor 3 is a passage formed between the pressure chamber 4 and the manifold 2. The pressure chamber 4 is formed to receive ink that is to be ejected. The piezoelectric actuator 6 operates to change the volume of the pressure chamber 4, and thereby, resulting in variations of the pressure in the pressure chamber 4. Thus, ink can be ejected from or introduced into the pressure chamber 4.

Ink channels can be respectively formed of ceramic, metal, or synthetic resin plates so as to be thin, and then, the plates can be stacked to form the channel plate 1. The piezoelectric actuator 6 is formed on the channel plate 1 above the pressure chamber 4. The piezoelectric actuator 6 has a stacked structure formed by a piezoelectric layer and electrodes. The electrodes are used to apply a voltage to the piezoelectric layer. Therefore, a portion of an upper wall of the channel plate 1 forming a top wall of the pressure chamber 4 is used as a vibration plate 1*a* that is deformed by the piezoelectric actuator 6.

An operation of the conventional piezoelectric inkjet head will now described. When the piezoelectric actuator 6 deforms the vibration plate 1*a* to reduce the volume of the pressure chamber 4, the pressure in the pressure chamber 4 increases, and thus, ink is ejected to the outside of the pressure chamber 4 through the nozzle 5. When the piezoelectric actuator 6 allows the vibration plate 1*a* to return its original shape in order to increase the volume of the pressure chamber 4, the pressure in the pressure chamber 4 decreases, and thus, ink is introduced into the pressure chamber 4 from the manifold 2 through the restrictor 3.

FIG. 2 is a perspective diagram illustrating a piezoelectric inkjet head disclosed in Korean Patent Laid-Open Publication NO. 2003-0050477 (U.S. Patent Publication NO. 2003-0112300) filed by the applicant of the present general inventive concept.

Referring to FIG. 2, the piezoelectric inkjet head includes three silicon substrates: an upper substrate 30, a middle substrate 40, and a lower substrate 50 that are bonded to one another. The upper substrate 30 includes a plurality of pressure chambers 32 formed in its bottom surface to a predetermined depth. An ink inlet 31 is formed through the upper substrate 30 and connected to an ink tank (not illustrated). The pressure chambers 32 are arranged in two rows at both sides of a manifold 41 formed in the middle substrate 40. Piezoelectric actuators 60 are disposed on a top surface of the upper substrate 30 to apply driving forces to their respective pressure chambers 32 in order to eject ink from the pressure chambers 32. The manifold 41 formed in the middle substrate 40 is connected to the ink inlet 31 of the upper substrate 30. Restrictors 42 are formed at both sides of the manifold 41, and are respectively connected to the pressure chambers 32 of the upper substrate 30. A plurality of vertical dampers 43 are formed through the middle substrate 40 relatively corresponding to the pressure chambers 32. A plurality of nozzles 51 are formed in the lower substrate 50, and connected to the dampers 43, respectively. Each of the nozzles 51 includes an ink introduction portion 51*a* and an ink ejection portion 51*b*. The ink introduction portion 51*a* is formed in an upper portion of the lower substrate 50, and the ink ejection portion 51*b* is formed in a lower portion of the lower substrate 50. The ink introduction portion 51*a* is formed in a reversed pyramid shape by anisotropic wet etching, and the ink ejection portion 51*b* is formed in a cylindrical shape having a constant diameter by dry etching.

However, in the conventional piezoelectric inkjet head illustrated in FIGS. 1 and 2, when the pressure in the pressure chambers 32 increases by the operation of the piezoelectric actuators 60, some of the ink stored in the pressure chambers 32 flows back to the manifold 41 through the restrictors 42, although most of the ink is ejected from the pressure chambers 32 through the nozzles 51. In addition, pressure waves or vibrations can be transmitted to the nozzles 51 of neighboring pressure chambers 32 together with the back flow of ink, thereby affecting ink ejection characteristics of the nozzles 51 of the neighboring pressure chambers 32. This phenomenon is called crosstalk. The crosstalk results in unstable ink meniscuses in the nozzles 51 of the neighboring pressure chambers 32. Thus, ink droplet speed and volume of the respective nozzles 51 are affected, thereby deteriorating image quality.

SUMMARY OF THE INVENTION

The present general inventive concept provides an inkjet head including a plurality of restrictors to restrain crosstalk and to improve ink ejection characteristics.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an inkjet head including: a channel plate in which an ink channel is formed; an actuator which is formed on the channel plate to apply a driving force to eject ink; and an ink-supply bezel which is coupled to a top surface of the channel plate and includes a manifold from which ink is supplied to the ink channel. The ink channel may include: an ink inlet which receives ink from the manifold; a plurality of reservoirs which store ink received through the ink inlet; a plurality of chambers which are filled with ink supplied from the respectively reservoirs; a plurality of nozzles which eject ink filled in the respectively chambers; a plurality of first restrictors which respectively connect the reservoirs to the chambers; and a plurality of second restrictors which respectively connect the reservoirs to the ink inlet.

The plurality of reservoirs may be separated from each other by a plurality of barrier walls.

The first restrictors may be respectively formed at sidewalls of the reservoirs near the chambers, and the second restrictors may be respectively formed at sidewalls of the reservoirs near the ink inlet.

Each of the first and second restrictors may have a T-shaped cross section and the same depth as the reservoirs.

Each of the reservoirs may include a first reservoir and a second reservoir that are separated by a central separation wall, and the separation wall may include a third restrictor which connects the first and second reservoirs.

The third restrictor may be formed at one side of the separation wall, and the channel plate may further include a connection path which connects the first and second reservoirs through the third restrictor. The third restrictor may have a T-shaped cross section.

The third restrictor may be formed through the separation wall.

The ink channel may further include flexible plates which are respectively formed on top portions of the reservoirs to absorb pressure waves transmitted to the reservoirs, and cavities which are formed on the flexible plates, respectively.

The ink channel may further include: flexible plates which are respectively formed on bottom portions of the reservoirs to absorb pressure waves transmitted to the reservoirs; and cavities which are formed under the flexible plates, respectively.

The channel plate may include an upper substrate, a middle substrate, and a lower substrate. In this case, the ink inlet may be formed vertically through the upper substrate, the chambers may be formed in a bottom surface of the upper substrate to a predetermined depth, the reservoirs and the first and second restrictors may be formed in the middle substrate, and the nozzles may be formed vertically through the lower substrate.

The ink channel may further include a plurality of dampers which are formed vertically through the middle substrate to respectively connect the chambers to the nozzles.

Each of the reservoirs may include a first reservoir and a second reservoir that are separated by a central separation wall, and the separation wall may include a third restrictor which connects the first and second reservoirs. The third restrictor may be formed at one side of the separation wall, and a connection path may be formed in the bottom surface of the upper substrate for connecting the first and second reservoirs through the third restrictor.

The ink channel may further include flexible plates which are formed at the upper substrate on top of the respective reservoirs for absorbing pressure waves transmitted to the reservoirs, and cavities which are formed in a top surface of the upper substrate on top of the respective flexible plates.

The ink channel may further include flexible plates which are formed at the middle substrate under the respective reservoirs for absorbing pressure waves transmitted to the reservoirs, and cavities which are located under the flexible plates, respectively and formed in at least one of a bottom surface of the middle substrate and a top surface of the lower substrate.

The foregoing and/or other aspects and utilities of the present general inventive concept may also be achieved by providing an inkjet head including a channel plate in which an ink channel is formed, the ink channel including: an ink inlet to receive ink from an external source, a plurality of reservoirs to store ink received through the ink inlet, a plurality of chambers filled with ink supplied from respective ones of the reservoirs, a plurality of nozzles to eject ink filled in the respectively chambers, a plurality of first restrictors respectively connecting the reservoirs to the chambers, and a plurality of second restrictors respectively connecting the reservoirs to the ink inlet; and a plurality of actuators formed on the channel plate above respective ones of the plurality of chambers to apply a driving force to eject ink from the chambers.

The foregoing and/or other aspects and utilities of the present general inventive concept may also be achieved by providing an inkjet head including a channel plate in which an ink channel is formed, the ink channel including: an ink inlet to receive ink from an external source, a plurality of reservoirs to store ink received through the ink inlet, a plurality of chambers filled with ink supplied from respective ones of the reservoirs, a plurality of nozzles to eject ink filled in the respectively chambers, and at least two restrictors disposed along each path of the nozzle, chamber, reservoir and ink inlet to control the amount of ink flowing from the ink inlet to each nozzle and from each nozzle to the ink inlet; and an actuator disposed above each one of the plurality of chambers to apply a driving force to eject ink therefrom.

The at least two restrictors may include a first restrictor disposed between the chamber and the reservoir and a second restrictor disposed between the reservoir and the ink inlet.

Each of the plurality of reservoirs may include a first reservoir to receive ink from the first reservoir and transfer the received ink to the respective chamber and a second reservoir to receive ink from the ink inlet.

The at least two restrictors may include a first restrictor disposed between the chamber and the first reservoir, a second restrictor disposed between the first reservoir and the second reservoir, and a third restrictor disposed between the second reservoir and the ink inlet.

BRIEF DESCRIPTION OF THE DRAWINGS

The above and other aspects and utilities of the present general inventive concept will become more apparent by describing in detail exemplary embodiments thereof with reference to the attached drawings in which.

DETAILED DESCRIPTION OF THE PREFERRED EMBODIMENTS

Figure 1:
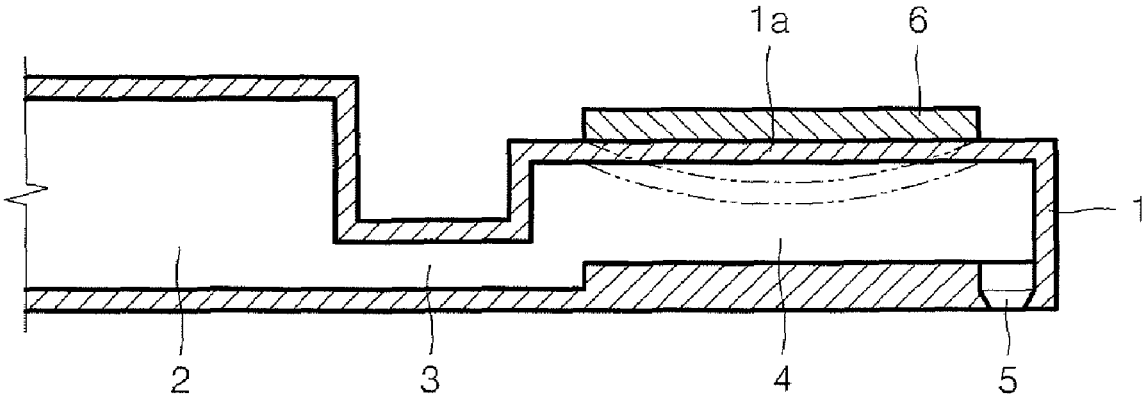
FIG. 1 (PRIOR ART)
FIG. 1 is a cross-sectional diagram schematically illustrating a general structure of a conventional piezoelectric inkjet head.
Figure 2:
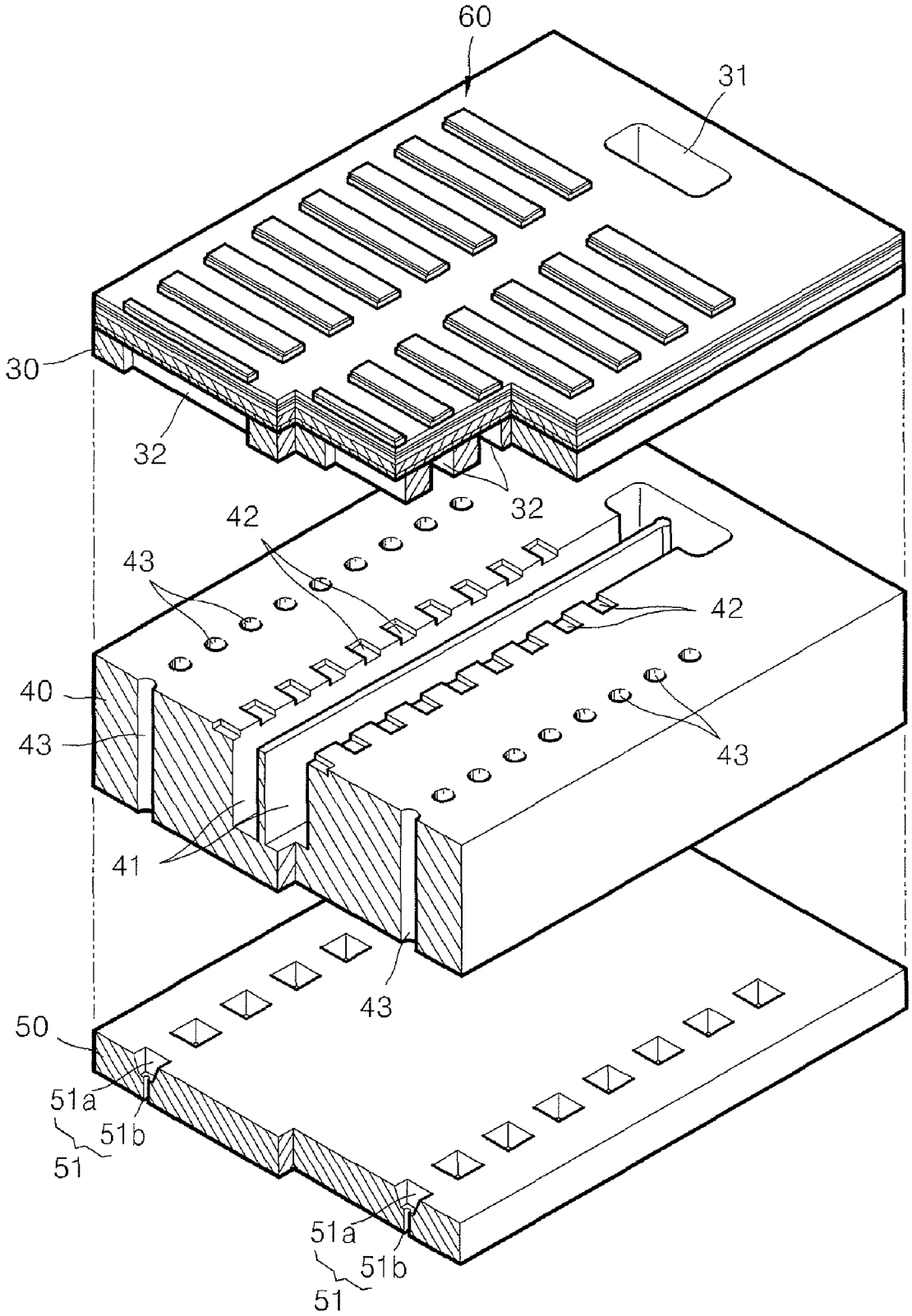
FIG. 2 (PRIOR ART)
FIG. 2 is an exploded perspective diagram illustrating an example of a conventional piezoelectric inkjet head.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3A:
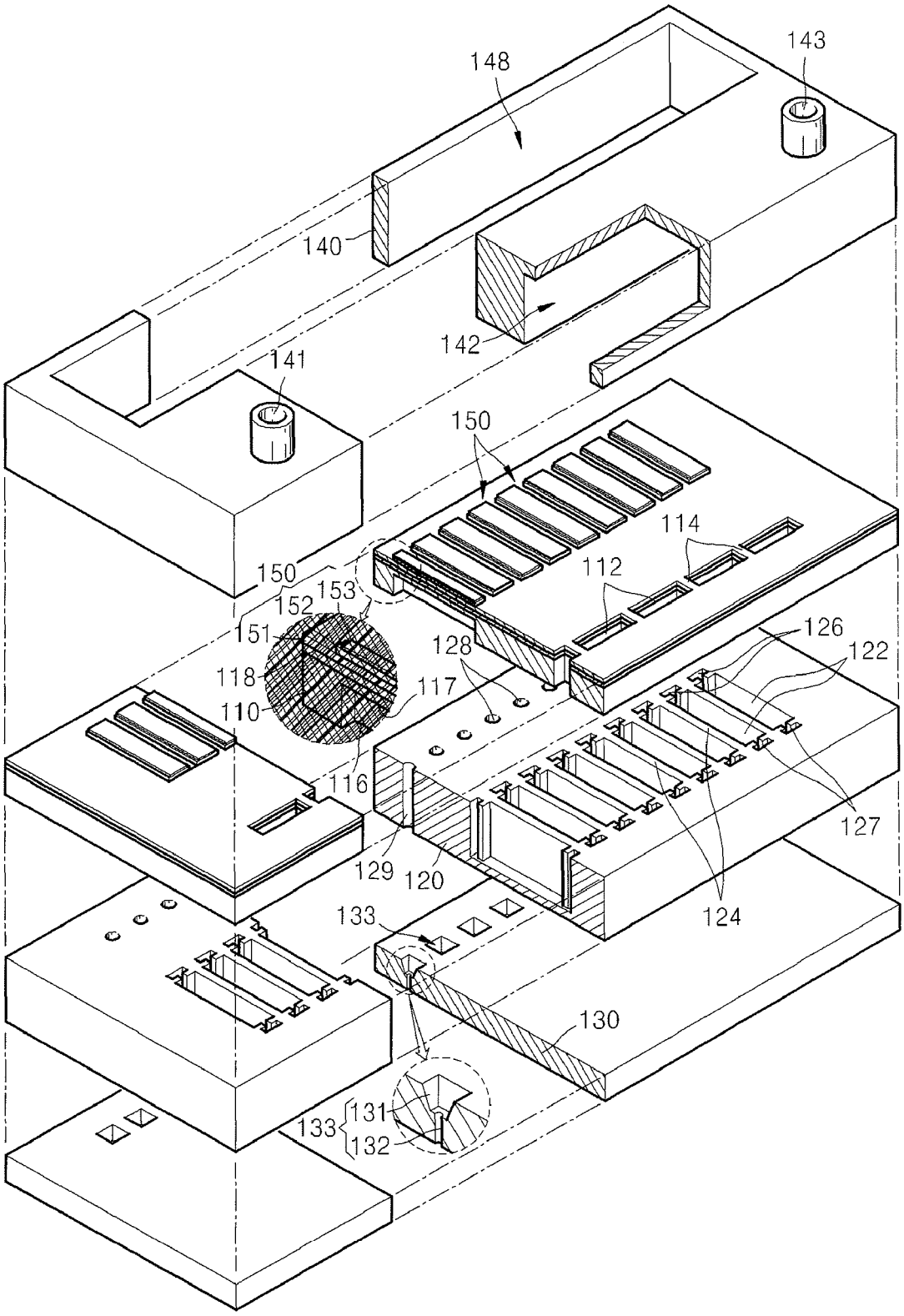
FIG. 3A is an exploded perspective diagram illustrating an inkjet head according to an embodiment of the present general inventive concept.
Figure 3B:
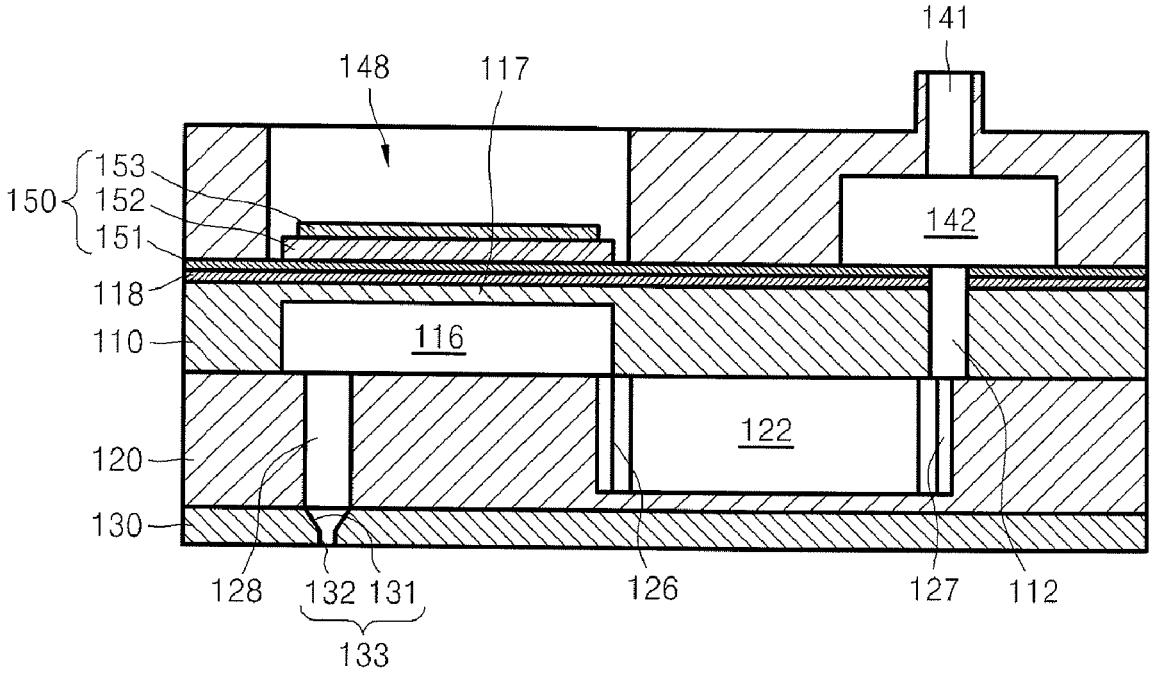
FIG. 3B is a vertical cross-sectional diagram of the inkjet head of FIG. 3A, taken in a length direction of a pressure chamber of the inkjet head for explaining an assembled state of the inkjet head, according to an embodiment of the present general inventive concept.

FIG. 3A is an exploded perspective diagram illustrating an inkjet head according to an embodiment of the present general inventive concept, and FIG. 3B is a vertical cross-sectional diagram of the inkjet head of FIG. 3A, taken in a length direction of a pressure chamber of the inkjet head illustrating an assembled state of the inkjet head, according to an embodiment of the present general inventive concept.

Referring to FIGS. 3A and 3B, the inkjet head of the current embodiment includes channel plates 110, 120, and 130 in which an ink channel is formed, actuators 150 formed on the channel plate 110 to apply driving forces to eject ink, and an ink-supply bezel 140 coupled to the channel plate 110 and including a manifold 142 to supply ink to the ink channel.

The ink channel formed in the channel plates 110, 120, and 130 includes ink inlets 112 allowing an inflow of ink from the manifold 142 of the ink-supply bezel 140, a plurality of reservoirs 122 to store ink received through the ink inlets 112, a plurality of chambers 116 to store ink received from the respective reservoirs 122, and a plurality of nozzles 133 through which ink is ejected from the chambers 116. The ink channel further includes a plurality of first restrictors 126 to respectively connect the reservoirs 122 to the chambers 116, and a plurality of second restrictors 127 to connect the reservoirs 122 to the ink inlets 112. The ink channel may further include a plurality of dampers 128 to respectively connect the chambers 116 to the nozzles 133. The ink channel will be described later in more detail.

The channel plates 110, 120, and 130 may be formed of and hereinafter referred to respectively as an upper substrate 110, a middle substrate 120, and a lower substrate 130. In this case, the actuators 150 can be formed on a top surface of the upper substrate 110. The upper, middle, and lower substrates 110, 120, and 130 may be silicon substrates that are widely used for semiconductor integrated circuits.

The inkjet head includes three channel plates 110, 120, and 130 in the current embodiment, however, the present general inventive concept is not limited thereto and the inkjet head can include two or more channel plates. The channel plates 110, 120, and 130 are exemplarily illustrated in FIGS. 3A, and 3B. Hence, the inkjet head of the present general inventive concept is characterized by the first and second restrictors 126 and 127 of the ink channel formed in the channel plates 110, 120, and 130, rather than the channel plates 110, 120, and 130.

The ink-supply bezel 140 is coupled to the upper substrate 110 and includes the manifold 142 to store ink and supply the ink to the ink channel through the ink inlets 112. The ink-supply bezel 140 further includes an ink supply port 141 through which ink is filled into the manifold 142, and an air discharge port 143 through which air bubbles included in the ink of the manifold 142 is discharged. The manifold 142 is formed on a bottom surface of the ink-supply bezel 140 to a predetermined depth and is connected to the ink inlets 112 formed in the upper substrate 110. The ink supply port 141 may be formed at one end of the top surface of the manifold 142, and the air discharge port 143 may be formed at the other end of the top surface of the manifold 142. Hence, the ink supply port 141 and the air discharge port 143 may be spaced apart from each other.

An opening 148 is formed in the ink-supply bezel 140 to expose the actuators 150 formed on the top surface of the upper substrate 110 to the outside. A flexible printed circuit (FPC) (not illustrated) can be connected to the actuators 150 through the opening 148 to apply voltages to the actuators 150.

The ink channel of the inkjet head will now described in more detail.

The chambers 116 can be formed in the bottom surface of the upper substrate 110 to a predetermined depth. Portions of the upper substrate 110 forming top walls of the chambers 116 are referred to as vibration plates 117. The vibration plates 117 are vibrated by the actuators 150. The chambers 116 can be arranged in one or two rows, and each of the chambers 116 can have a rectangular shape with its length in a direction of ink flow.

The ink inlets 112 supply ink from the manifold 142 to the reservoirs 122. The ink inlets 112 may be formed vertically through the upper substrate 110. The ink inlets 112 can be arranged in a row with their length along the manifold 142. In the current embodiment, the ink inlets 112 are separated by a plurality of barrier walls 114.

The reservoirs 122 can be formed in a top surface of the middle substrate 120 to a predetermined depth. Alternatively, the reservoirs 122 can be formed vertically through the middle substrate 120. The reservoirs 122 can be parallel to each other and be arranged in the same direction as the chambers 116. The reservoirs 122 are separated by a plurality of barrier walls 124. The reservoirs 122 are connected to the chambers 116 through the first restrictors 126, respectively. Furthermore, the reservoirs 112 are connected to the ink inlets 112 through the second restrictors 127, respectively.

The first restrictors 126 are paths between the reservoirs 122 and the chambers 116, and the second restrictors 127 are paths between the reservoirs 122 and the ink inlets 112. Accordingly, the first restrictors 126 are formed at sidewalls of the reservoirs 122 near the chambers 116, respectively, and the second restrictors 127 are formed at sidewalls of the reservoirs 122 near the ink inlets 112, respectively. The first restrictors 126 are smaller in sectional area than the chambers 116, and the second restrictors 127 are smaller in sectional area than the ink inlets 112, in order to prevent a back flow of ink. The first and second restrictors 126 and 127 can be formed in the middle substrate 120 to the same depth as the reservoirs 122. The first and second restrictors 126 and 127 can have a T-shaped section. The first and second restrictors 126 and 127 can have various shapes different from that illustrated in FIG. 3A.

The first and second restrictors 126 and 127 allow streams of ink from the ink inlets 112 to the chambers 116. More specifically, the first restrictors 126 allow streams of ink from the reservoirs 122 to the chambers 116 while the second restrictors 127 allow streams of ink from the inlets 112 to the reservoirs 122. Furthermore, the first and second restrictors 126 and 127 also prevent ink from flowing back from the chambers 116 to the ink inlets 112. This will be described later in more detail.

The dampers 128 can be formed vertically through the middle substrate 120 and connected to the chambers 116, respectively.

The nozzles 133 can be formed vertically through the lower substrate 130 in connection with the dampers 128, respectively. Each of the nozzles 133 can include an ink ejection port 132 and an ink introduction portion 131. The ink ejection port 132 is formed in a lower portion of the lower substrate 130 to eject ink, and the ink introduction portion 131 is formed in an upper portion of the lower substrate 130 to guide ink from the damper 128 to the ink ejection port 132. The ink ejection port 132 can be a vertical cylindrical port having a constant diameter. The ink introduction portion 131 can have a reversed quadrangular pyramid shape with a cross section decreasing from the damper 128 to the ink ejection port 132.

The actuators 150 can be formed on the top surface of the upper substrate 110. An insulation layer 118 can be formed between the upper substrate 110 and the actuators 150. If the upper substrate 110 is a silicon substrate, the insulation layer 118 can be formed of a silicon oxide. Each of the actuators 150 can include a lower electrode 151, a piezoelectric layer 152 that deforms due to an applied voltage, and an upper electrode 153 used as a driving electrode. The lower electrode 151 can be used as a common electrode for all the actuators 150. In this case, the lower electrode 151 can be formed on the entire surface of the insulation layer 118 using a conductive metal. The piezoelectric layer 152 is formed on the lower electrode 151 above a corresponding chamber 116. The piezoelectric layer 152 may be formed of a piezoelectric material such as a lead zirconate titanate (PZT) ceramic material. If a voltage is applied to the piezoelectric layer 152, the piezoelectric layer 152 deforms, and thus, the vibration plate 117 forming a top wall of the chamber 116 can vibrate. The upper electrode 153 is formed on the piezoelectric layer 152 as a driving electrode that applies a voltage to the piezoelectric layer 152.

The inkjet head of the current embodiment can be formed by coupling the ink-supply bezel 140 to the upper substrate 110 after bonding the upper substrate 110, the middle substrate 120, and the lower substrate 130 to one another. In the upper, middle, and lower substrates 110, 120, and 130, the ink inlets 112, the second restrictors 127, the reservoirs 122, the first restrictors 126, the chambers 116, the dampers 128, and the nozzles 133 are sequentially connected to form the ink channel in the inkjet head.

Figure 4A:
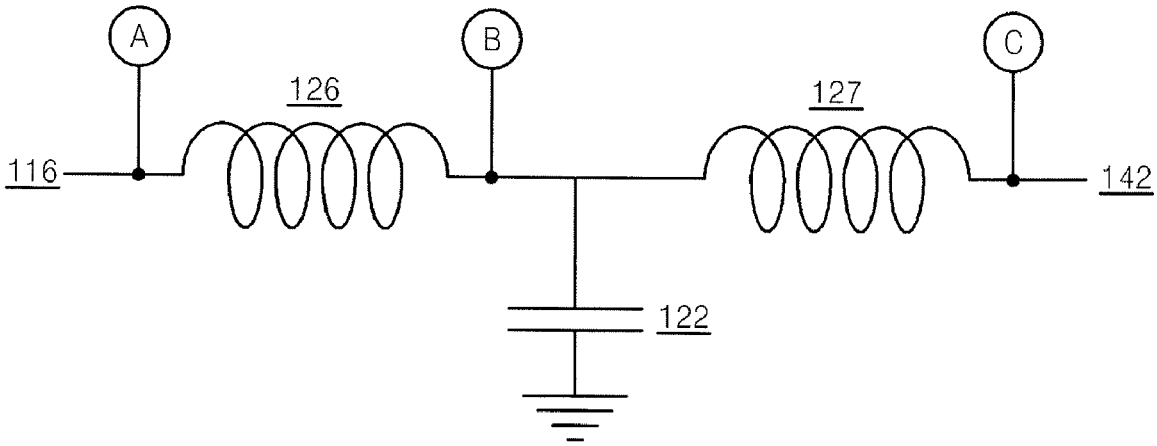
FIG. 4A is an equivalent circuit diagram of an ink channel structure of the inkjet head of FIGS. 3A and 3B.
Figure 4B:
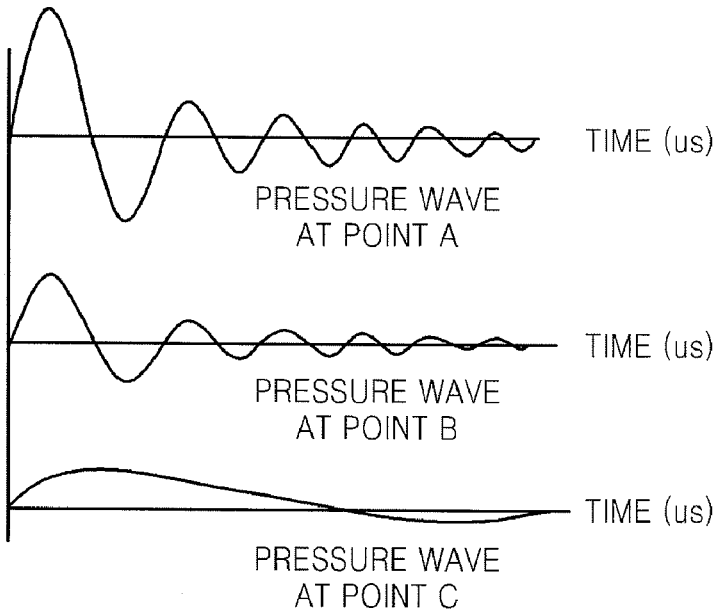
FIG. 4B is a graph illustrating pressure waves generated at marked points of FIG. 4A.

FIG. 4A is an equivalent circuit diagram of the ink channel structure of the inkjet head of FIGS. 3A and 3B, and FIG. 4B is a graph illustrating pressure waves generated at marked points of FIG. 4A.

Referring to FIG. 4A, the chamber 116 is connected to the manifold 142 through the first restrictor 126, the reservoir 122, and the second restrictor 127. The first and second restrictors 126 and 127 may be equivalent to inductances L, and the reservoir 122 may be equivalent to a capacitance C. Therefore, in the equivalent circuit, the inductances L and the capacitance C form a low pass filter.

A pressure wave generated by an activity of the actuator 150 is transmitted from the chamber 116 to the manifold 142. During that operation, the pressure wave passes sequentially through the first restrictor 126, the reservoir 122, and the second restrictor 127 that form the low pass filter. Therefore, a high-frequency component of the pressure wave is removed, and only a low-frequency component of the pressure wave is transmitted to the manifold 142. Referring to FIG. 4B, the pressure wave has a high-frequency component at the chamber 116 (at point A of FIG. 4*a*). However, when the pressure wave is at a point B of FIG. 4A after passing through the first restrictor 126, the high-frequency component of the pressure wave is somewhat removed. When the pressure wave is at a point C of FIG. 4A after passing through the reservoir 122 and the second restrictor 127, the high-frequency component of the pressure wave is almost completely removed.

As explained above, according to the embodiment illustrated in FIG. 3B, one reservoir 122 and two restrictors 126 and 127 are disposed between each of the chambers 116 and the manifold 142. Therefore, a back flow of ink and a pressure wave from the chamber 116 can be effectively restrained when ink is ejected from chamber 116. That is, crosstalk between neighboring nozzles 133 can be prevented when ink is ejected. As a result, the ink-ejection characteristics of the inkjet head can be improved. For example, the volume and speed of ink droplets ejected through the nozzles 133 can be uniform.

Figure 5:
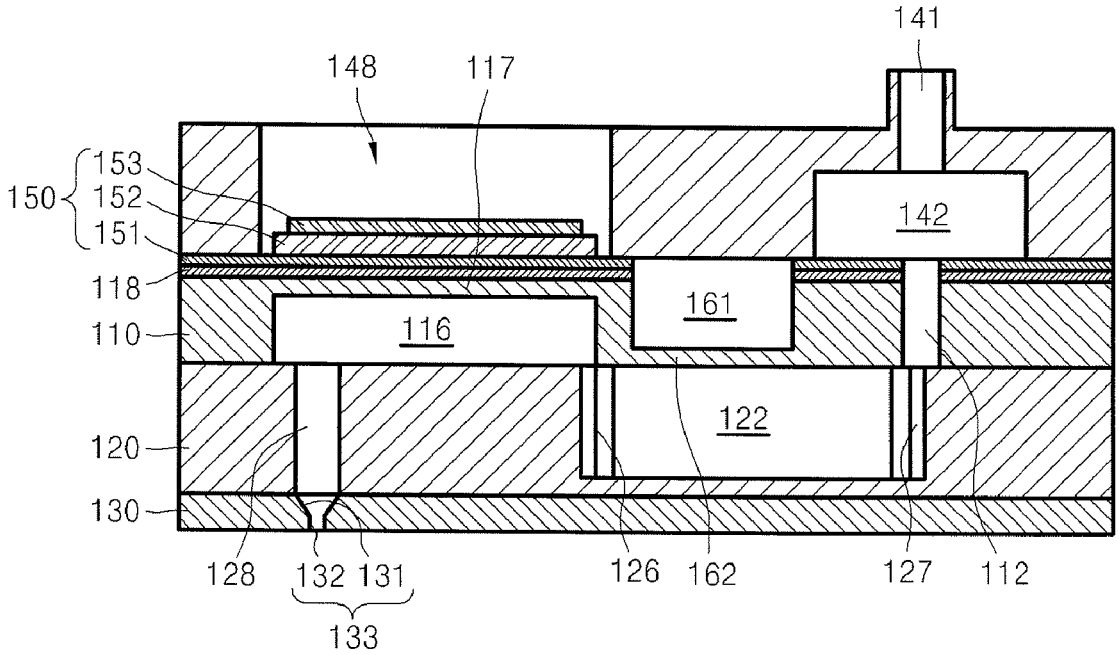
FIG. 5 is a vertical cross-sectional diagram illustrating an inkjet head according to another embodiment of the present general inventive concept.
Figure 6:
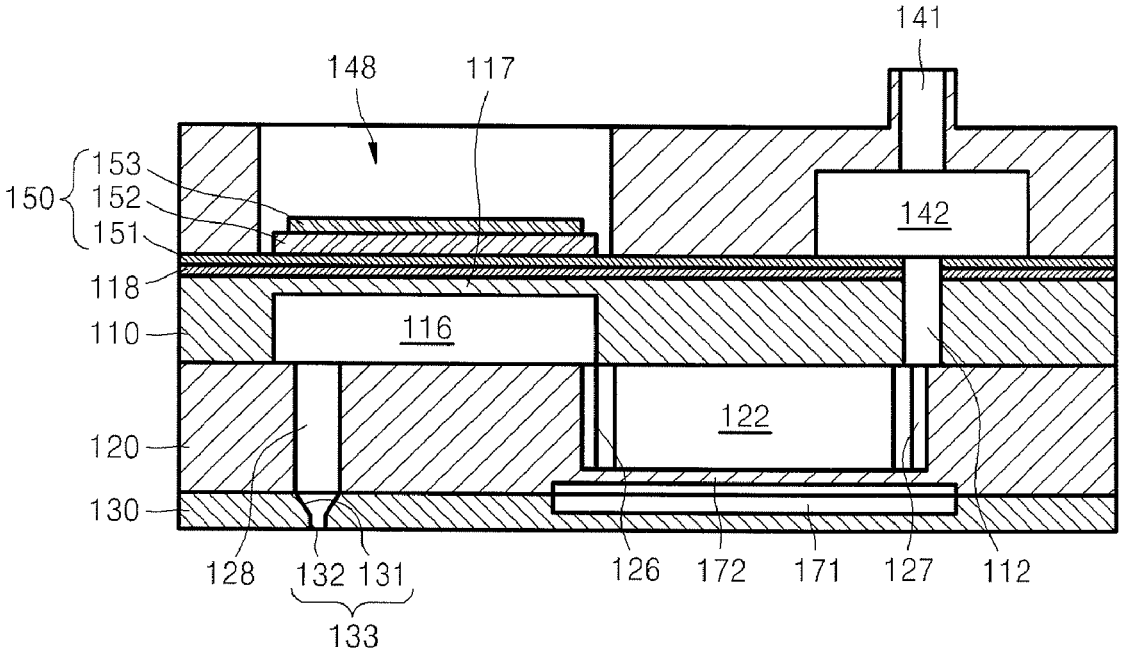
FIG. 6 is a vertical cross-sectional diagram illustrating an inkjet head according to another embodiment of the present general inventive concept.

FIGS. 5 and 6 are vertical cross-sectional diagrams illustrating inkjet heads according to other embodiments of the present general inventive concept.

Referring to FIG. 5, a cavity 161 is formed in an upper substrate 110 to a predetermined depth, and as a result, a thin flexible plate 162 is formed at the bottom of the cavity 161 as a top wall of a reservoir 122.

Referring to FIG. 6, a thin flexible plate 172 is formed at the bottom of a reservoir 122 in a middle substrate 120, and a cavity 171 is formed under the flexible plate 172. The cavity 171 can be formed by partially removing a bottom surface of the middle substrate 120 and a top surface of a lower substrate 130 to predetermined depths. Alternatively, the cavity 171 can be formed only in the bottom surface of the middle substrate 120 or the top surface of the lower substrate 130.

The flexible plates 162 and 172 illustrated in FIGS. 5 and 6 absorb a pressure wave transmitted to the reservoir 122. Each of the flexible plates 162 and 172 may have a thickness in the range of 10 μm to 30 μm. When the flexible plates 162 and 172 are excessively thick, the flexible plates 162 and 172 do not easily deform, and thus a pressure wave is not readily absorbed. In contrast, when the flexible plates 162 and 172 are excessively thin, the flexible plates 162 and 172 can be easily broken or damaged. The cavities 161 and 171 allow the flexible plates 162 and 172 to freely deform.

As illustrated in FIGS. 5 and 6, a pressure wave transmitted to the reservoir 122 can be absorbed by forming a flexible plate such as the flexible plates 162 and 172 at an upper or lower side of the reservoir 122. In other words, the reservoir 122 can be more flexible owing to the flexible plate 162 or 172, and thus the capacitance C of the low pass filter illustrated in FIG. 4A can be increased. As a result, only a much lower frequency component of a pressure wave can pass through the reservoir 122.

Figure 7A:
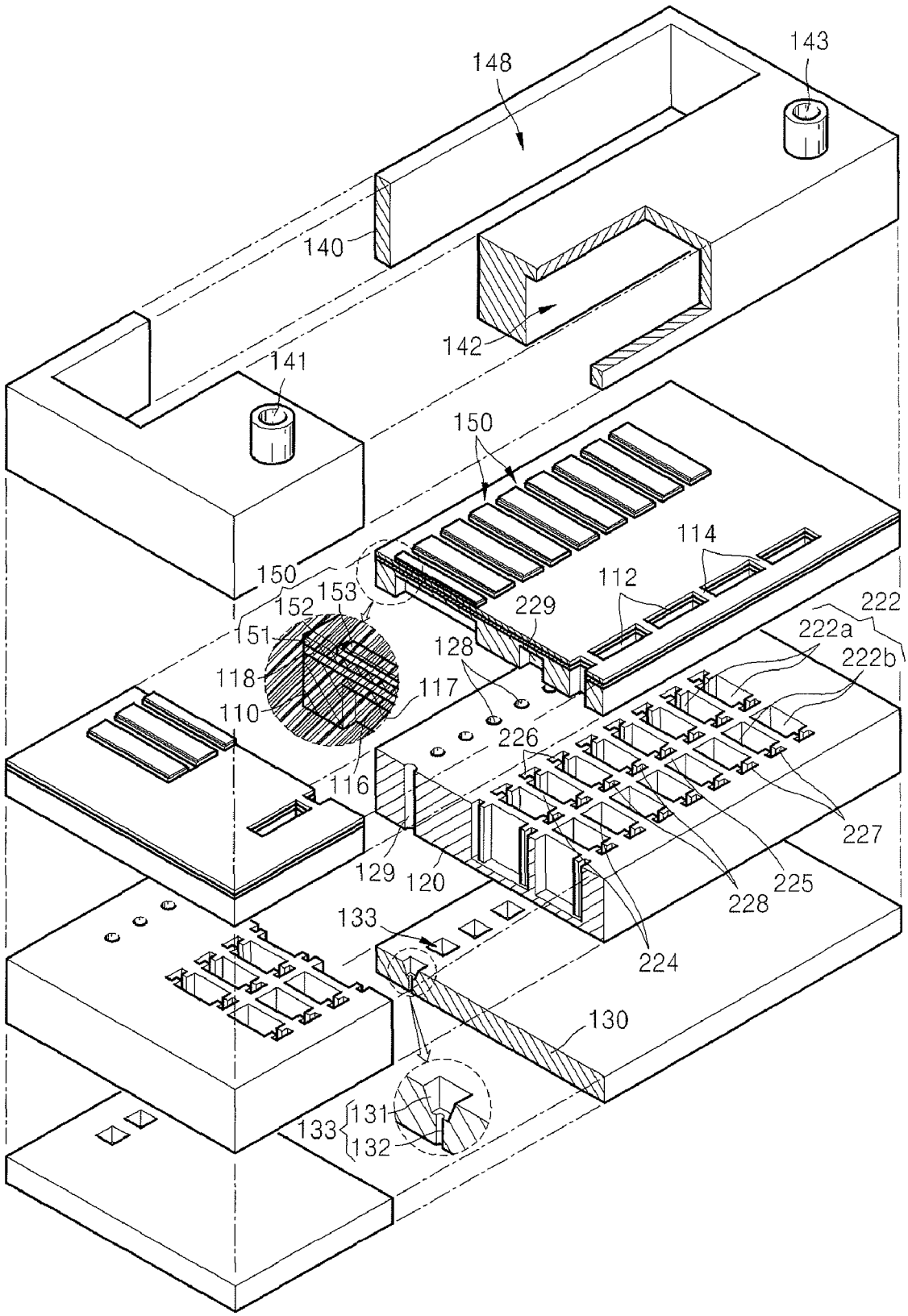
FIG. 7A is an exploded perspective diagram illustrating an inkjet head according to another embodiment of the present general inventive concept.
Figure 7B:
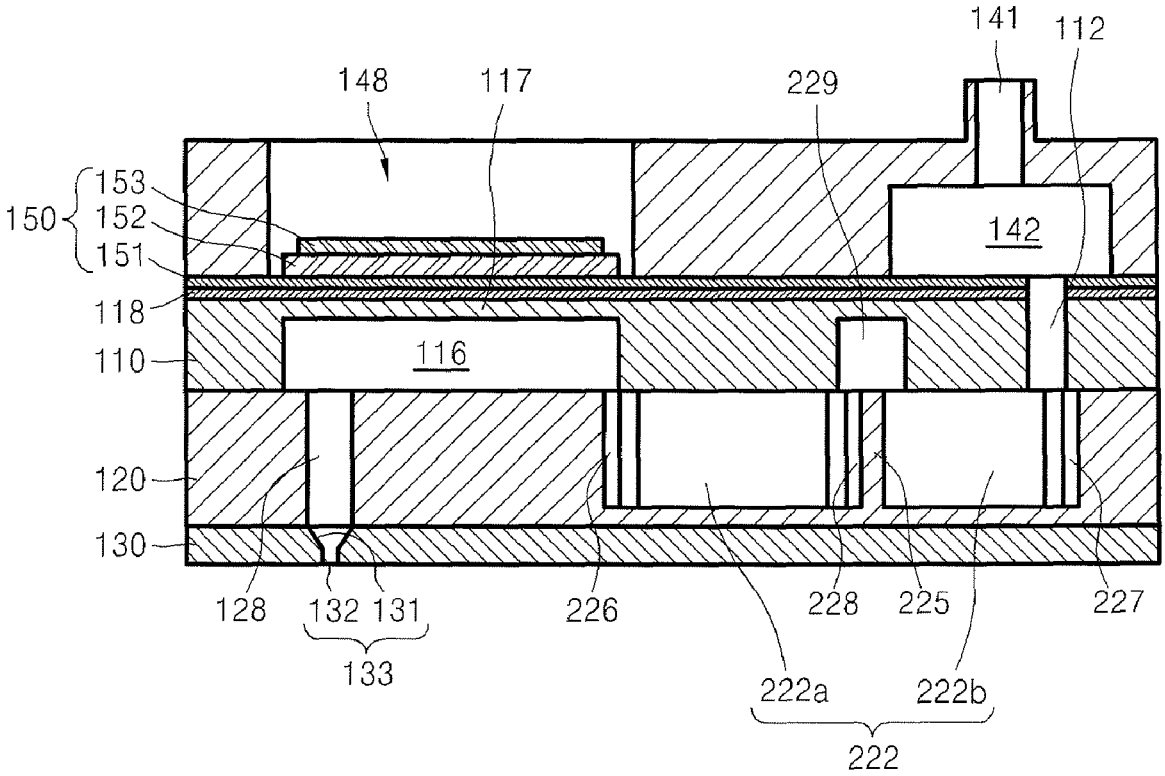
FIG. 7B is a vertical cross-sectional diagram of the inkjet head of FIG. 7A, taken in a length direction of a pressure chamber of the inkjet head to illustrate an assembled state of the inkjet head, according to an embodiment of the present general inventive concept.

FIG. 7A is an exploded perspective diagram illustrating an inkjet head according to another embodiment of the present general inventive concept, and FIG. 7B is a vertical cross-sectional diagram of the inkjet head of FIG. 7A, taken in a length direction of a pressure chamber of the inkjet head for explaining an assembled state of the inkjet head, according to an embodiment of the present general inventive concept.

Referring to FIGS. 7A and 7B, the inkjet head of the current embodiment includes channel plates 110, 120, and 130 in which an ink channel is formed, actuators 150, and a ink-supply bezel 140 in which a manifold 142 is formed. The ink-supply bezel 140 and the actuators 150 have the same structures as those illustrated in FIGS. 3A and 3B. Thus, descriptions thereof will be omitted. The channel plates 110, 120, and 130 have the same structure as those illustrated in FIGS. 3A and 3B except that the ink channel formed in the channel plates 110, 120, and 130 has a different structure.

The ink channel includes ink inlets 112 receiving ink from the manifold 142 of the ink-supply bezel 140, a plurality of chambers 116, and a plurality of nozzles 133. The ink channel can further include a plurality of dampers 128 respectively connected the chambers 116 to the nozzles 133. The ink inlets 112, the chambers 116, the nozzles 133, and the dampers 128 have the same structures as those illustrated in FIGS. 3A and 3B.

The ink channel further includes a plurality of reservoirs 222 separated by a plurality of barrier walls 224 to store ink received through the ink inlets 112. The reservoirs 222 can be formed in a top surface of the middle substrate 120 to a predetermined depth. Alternatively, the reservoirs 222 can be formed through the middle substrate 120.

In the current embodiments illustrated in FIGS. 7A and 7B, the reservoirs 222 include first reservoirs 222*a* and second reservoirs 222*b*. The first reservoirs 222*a* are separated from the second reservoirs 222*b* by a separation wall 225. The ink channel further includes first restrictors 226 to respectively connect the chambers 116 to the first reservoirs 222*a*, second restrictors 227 to respectively connect the second reservoirs 222*b* to the ink inlets 112, and third restrictors 228 to respectively connect the first restrictors 222*a* to the second restrictors 222*b*. That is, the first reservoirs 222*a* are connected to the chambers 116 through the first restrictors 226, respectively, and the second reservoirs 222*b* are connected to the ink inlets 112 through the second restrictors 227, respectively. Further, the first reservoirs 222*a* are connected to the second reservoirs 222*b* through the third restrictors 228, respectively. For this, the first restrictors 226 are formed at sidewalls of the first reservoirs 222*a* near the chambers 116, respectively, and the second restrictors 227 are formed at sidewalls of the second reservoirs 222*b* near the ink inlets 112, respectively. The third restrictors 228 can be formed at a side of the separation wall 225. In FIGS. 7A and 7B, the third restrictors 228 are formed at a side of the separation wall 225 near the first reservoirs 222*a*. However, the third restrictors 228 can be formed at the other side of the separation wall 225 near the second reservoirs 222*b*. Connection paths 229 are formed in a bottom surface of the upper substrate 110 to a predetermined depth to respectively connect the first reservoirs 222*a* to the second reservoirs 222*b* through the third restrictors 228.

Each of the first to third restrictors 226, 227, and 228 has a cross section smaller than those of the chambers 116 and the reservoirs 222, in order to prevent a back flow of ink. Each of the first to third restrictors 226, 227, and 228 can be formed in the middle substrate 120 to the same depth as the reservoirs 222. Each of the first to third restrictors 226, 227, and 228 can have a T-shaped cross section. The first to third restrictors 226, 227, and 228 can have different shapes from the shape illustrated in FIGS. 7A and 7B.

Figure 8:
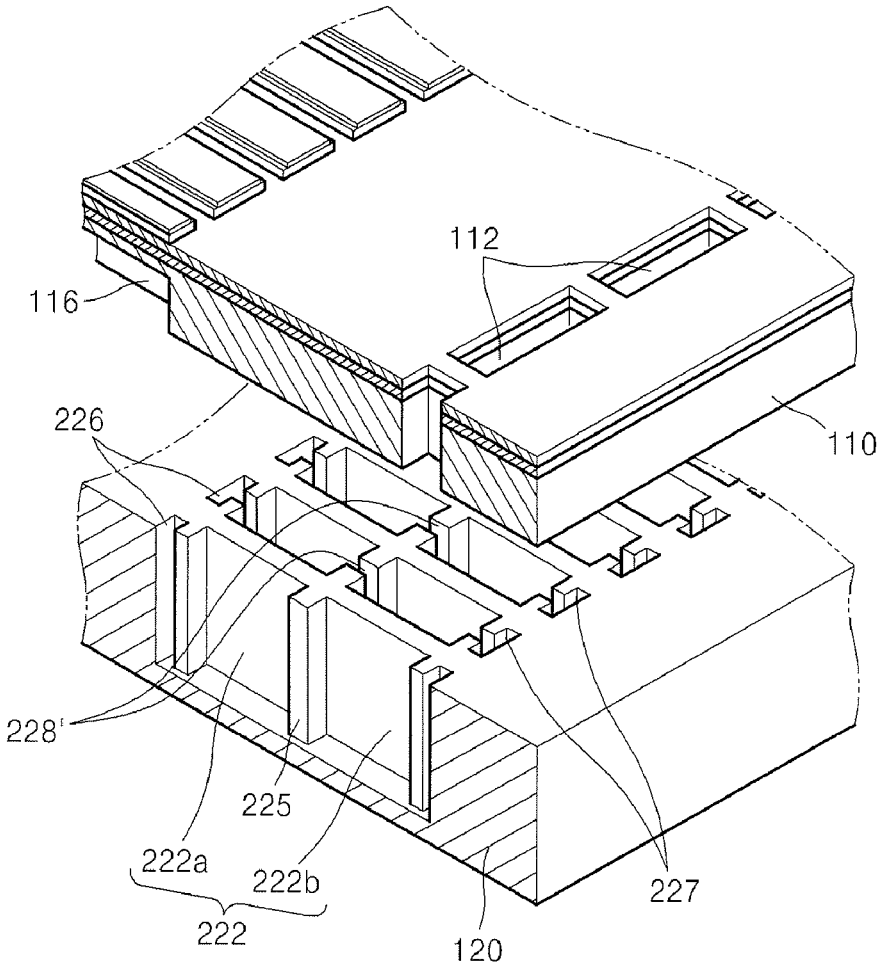
FIG. 8 is a partial perspective diagram illustrating a modification version of a third restrictor depicted in FIGS. 7A and 7B, according to an embodiment of the present general inventive concept.

FIG. 8 is a partial perspective diagram illustrating a modification version of the third restrictors 228 depicted in FIGS. 7A and 7B, according to an embodiment of the present general inventive concept.

Referring to FIG. 8, third restrictors 228' are formed through the separation wall 225 to connect the first reservoirs 222*a* to the second reservoirs 222*b*. The third restrictors 228' have a small width. Since the third restrictors 228' directly connect the first reservoirs 222*a* to the second reservoirs 222*b*, it is not required to form the connection paths 229 in the upper substrate 110 as illustrated in FIGS. 7A and 7B.

The cavities 161 and 171, and the flexible plates 162 and 172 illustrated in FIGS. 5 and 6 can be formed in the inkjet head of FIGS. 7A and 7B.

Figure 9:
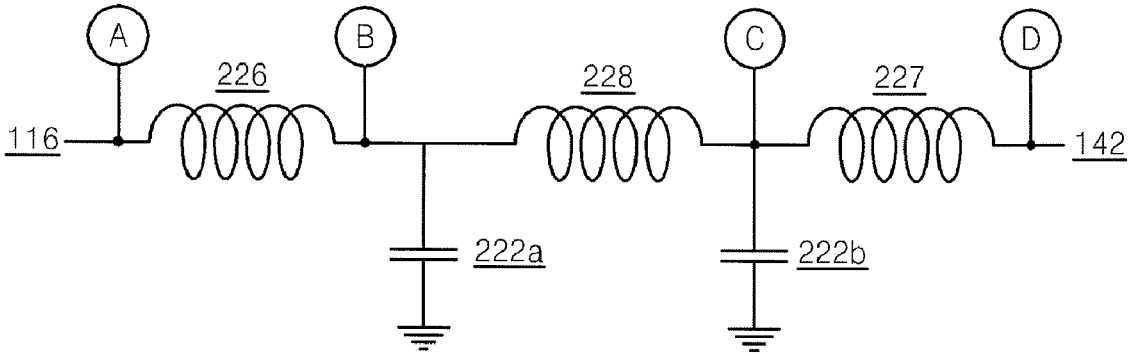
FIG. 9 is an equivalent circuit diagram of an ink channel structure of the inkjet head depicted in FIGS. 7A and 7B.

FIG. 9 is an equivalent circuit diagram of the ink channel structure of the inkjet head depicted in FIGS. 7A and 7B.

Referring to FIG. 9, the chamber 116 is connected to the manifold 142 through the first restrictor 226, the first reservoir 222*a*, the third restrictor 228, the second reservoir 222*b*, and the second restrictor 227. The first to third restrictors 226, 227, and 228 can be equivalent to inductances L, and the first and second reservoirs 222*a* and 222*b* can be equivalent to a capacitances C. Therefore, in the equivalent circuit, the inductances L and the capacitance C form a low pass filter. The low pass filter of FIG. 9 includes one more inductance L and one more capacitance C than the low pass filter of FIG. 4A. Therefore, when a pressure wave generated at the chamber 116 by the operation of the actuator 150 is transmitted to the manifold 142, a high-frequency component of the pressure wave can be removed more efficiently.

As described above, according to the inkjet head of the various embodiments of the present general inventive concept, at least two restrictors are disposed between each of the chambers and the manifold. Therefore, back flows of ink and pressure waves from the chambers to the manifold can be effectively restrained when ink is ejected from chambers. That is, crosstalk between neighboring nozzles can be prevented when ink is ejected. As a result, the ink-ejection characteristics of the inkjet head can be improved. For example, the volume and speed of ink droplets ejected through the nozzles can be uniform.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An inkjet head comprising:

a channel plate in which an ink channel is formed;

an actuator formed on the channel plate to apply a driving force to eject ink; and an ink-supply bezel coupled to a top surface of the channel plate and including a manifold from which ink is supplied to the ink channel, wherein the ink channel includes:

an ink inlet to receive ink from the manifold;

a plurality of reservoirs to store ink received through the ink inlet;

a plurality of chambers filled with ink supplied from the respective reservoirs;

a plurality of nozzles to eject ink filled in the respective chambers;

a plurality of first restrictors respectively connecting the reservoirs to the chambers; and a plurality of second restrictors respectively connecting the reservoirs to the ink inlet;

wherein the respective chambers and corresponding reservoirs are formed on different planes; and each of the first and second restrictors has a T-shaped cross section.

2. The inkjet head of claim 1, wherein the reservoirs are separated from each other by a plurality of barrier walls.

3. The inkjet head of claim 1, wherein the first restrictors are respectively formed at sidewalls of the reservoirs near the chambers, and the second restrictors are respectively formed at sidewalls of the reservoirs near the ink inlet.

4. The inkjet head of claim 1, wherein the first and second restrictors have the same depth as the reservoirs.

5. The inkjet head of claim 1, wherein the ink channel further includes:

flexible plates respectively formed on bottom portions of the reservoirs to absorb pressure waves transmitted to the reservoirs; and cavities formed under the flexible plates, respectively.

6. The inkjet head of claim 1, wherein the channel plate comprises an upper substrate, a middle substrate, and a lower substrate.

7. The inkjet head of claim 6, wherein the ink inlet is formed vertically through the upper substrate, the chambers are formed in a bottom surface of the upper substrate to a predetermined depth, the reservoirs and the first and second restrictors are formed in the middle substrate, and the nozzles are formed vertically through the lower substrate.

8. The inkjet head of claim 7, wherein the ink channel further includes:

flexible plates formed at the middle substrate under the respective reservoirs to absorb pressure waves transmitted to the reservoirs; and cavities located under the flexible plates, respectively, the cavities being formed in at least one of a bottom surface of the middle substrate and a top surface of the lower substrate.

9. An inkjet head comprising:

a channel plate in which an ink channel is formed;

an actuator formed on the channel plate to apply a driving force to eject ink; and an ink-supply bezel coupled to a top surface of the channel plate and including a manifold from which ink is supplied to the ink channel, wherein the ink channel includes:

an ink inlet to receive ink from the manifold;

a plurality of reservoirs to store ink received through the ink inlet;

a plurality of chambers filled with ink supplied from the respective reservoirs;

a plurality of nozzles to eject ink filled in the respective chambers;

a plurality of first restrictors respectively connecting the reservoirs to the chambers; and a plurality of second restrictors respectively connecting the reservoirs to the ink inlet;

wherein the respective chambers and corresponding reservoirs are formed on different planes; and each of the reservoirs comprises a first reservoir and a second reservoir that are separated by a central separation wall, and the separation wall comprises a third restrictor connecting the first and second reservoirs.

10. The inkjet head of claim 9, wherein the third restrictor is formed at one side of the separation wall, and the channel plate further includes a connection path connecting the first and second reservoirs through the third restrictor.

11. The inkjet head of claim 10, wherein the third restrictor has a T-shaped cross section.

12. The inkjet head of claim 9, wherein the third restrictor is formed through the separation wall.

13. An inkjet head comprising:

a channel plate in which an ink channel is formed;

an actuator formed on the channel plate to apply a driving force to eject ink; and an ink-supply bezel coupled to a top surface of the channel plate and including a manifold from which ink is supplied to the ink channel, wherein the ink channel includes:

an ink inlet to receive ink from the manifold;

a plurality of reservoirs to store ink received through the ink inlet;

a plurality of chambers filled with ink supplied from the respective reservoirs;

a plurality of nozzles to eject ink filled in the respective chambers;

a plurality of first restrictors respectively connecting the reservoirs to the chambers;

a plurality of second restrictors respectively connecting the reservoirs to the ink inlet;

flexible plates respectively formed on top portions of the reservoirs to absorb pressure waves transmitted to the reservoirs; and cavities formed on the flexible plates, respectively;

wherein the respective chambers and corresponding reservoirs are formed on different planes.

14. An inkjet head comprising:

a channel plate in which an ink channel is formed, the channel plate comprising an upper substrate, a middle substrate, and a lower substrate;

an actuator formed on the channel plate to apply a driving force to eject ink; and an ink-supply bezel coupled to a top surface of the channel plate and including a manifold from which ink is supplied to the ink channel, wherein the ink channel includes:

an ink inlet formed vertically through the us se substrate to receive ink from the manifold;

a plurality of reservoirs formed in the middle substrate to store ink received through the ink inlet;

a plurality of chambers filled with ink supplied from the respective reservoirs and formed in a bottom surface of the upper substrate to a predetermined depth;

a plurality of nozzles formed vertically through the lower substrate to eject ink filled in the respective chambers;

a plurality of first restrictors respectively connecting the reservoirs to the chambers and formed in the middle substrate;

a plurality of second restrictors respectively connecting the reservoirs to the ink inlet and formed in the middle substrate, and a plurality of dampers formed vertically through the middle substrate to respectively connect the chambers to the nozzles, wherein the respective chambers and corresponding reservoirs are formed on different planes.

15. An inkjet head comprising:

a channel plate in which an ink channel is formed, the channel plate comprising an upper substrate, a middle substrate, and a lower substrate;

an actuator formed on the channel plate to apply a driving force to eject ink; and an ink-supply bezel coupled to a top surface of the channel plate and including a manifold from which ink is supplied to the ink channel, wherein the ink channel includes:

an ink inlet formed vertically through the upper substrate to receive ink from the manifold;

a plurality of reservoirs formed in the middle substrate to store ink received through the ink inlet;

a plurality of chambers filled with ink supplied from the respective reservoirs and formed in a bottom surface of the upper substrate to a predetermined depth;

a plurality of nozzles formed vertical through the lower substrate to eject ink filled in the respective chambers;

a plurality of first restrictors respectively connecting the reservoirs to the chambers and formed in the middle substrate; and a plurality of second restrictors respectively connecting, the reservoirs to the ink inlet and formed in the middle substrate, wherein each of the reservoirs comprises a first reservoir and a second reservoir that are separated by a central separation wall, and the separation wall comprises a third restrictor connecting the first and second reservoirs, and the respective chambers and corresponding reservoirs are formed on different planes.

16. The inkjet head of claim 15, wherein the third restrictor is formed at one side of the separation wall, and a connection path is formed in the bottom surface of the upper substrate to connect the first and second reservoirs through the third restrictor.

17. An inkjet head comprising:

a channel plate in which an ink channel is formed, the channel plate comprising an upper substrate, a middle substrate, and a lower substrate;

an actuator formed on the channel plate to apply a driving force to eject ink; and an ink-supply bezel coupled to a top surface of the channel plate and including a manifold from which ink is supplied to the ink channel, wherein the ink channel includes:

an ink inlet formed vertically through the upper substrate to receive ink from the manifold;

a plurality of reservoirs formed in the middle substrate to store ink received through the ink inlet;

a plurality of chambers filled with ink supplied from the respective reservoirs and formed in a bottom surface of the upper substrate to a predetermined depth;

a plurality of nozzles formed vertically through the lower substrate to eject ink filled in the respective chambers;

a plurality of first restrictors respectively connecting the reservoirs to the chambers and formed in the middle substrate;

a plurality of second restrictors respectively connecting the reservoirs to the ink inlet and formed in the middle substrate;

flexible plates formed at the upper substrate on top of the respective reservoirs to absorb pressure waves transmitted to the reservoirs; and cavities formed in a top surface of the upper substrate on top of the respective flexible plates, wherein the respective chambers and corresponding reservoirs are formed on different planes.

18. An inkjet head comprising:

a channel plate in which an ink channel is formed, the ink channel including:

an ink inlet to receive ink from an external source, a plurality of reservoirs to store ink received through the ink inlet, a plurality of chambers filled with ink supplied from respective ones of the reservoirs, a plurality of nozzles to eject ink filled in the respective chambers, a plurality of first restrictors respectively connecting the reservoirs to the chambers, and a plurality of second restrictors respectively connecting the reservoirs to the ink inlet; and a plurality of actuators formed on the channel plate above respective ones of the plurality of chambers to apply a driving force to eject ink from the chambers;

wherein the respective chambers and corresponding reservoirs are formed on different planes, and each of the first and second restrictors has a T-shaped cross section.

19. An inkjet head comprising:

a channel plate in which an ink channel is formed, the ink channel including:

an ink inlet to receive ink from an external source, a plurality of reservoirs to store ink received through the ink inlet, a plurality of chambers filled with ink supplied from respective ones of the reservoirs, a plurality of nozzles to eject ink filled in the respective chambers, and at least two restrictors disposed along each path of the nozzle, chamber, reservoir and ink inlet to control the amount of ink flowing from the ink inlet to each nozzle and from each nozzle to the ink inlet; and an actuator disposed above each one of the plurality of chambers to apply a driving force to eject ink therefrom;

wherein the respective chambers and corresponding reservoirs are formed on different planes, and each of the first and second restrictors has a T-shaped cross section.

20. The inkjet head of claim 19, wherein the at least two restrictors comprises:

a first restrictor disposed between the chamber and the reservoir; and a second restrictor disposed between the reservoir and the ink inlet.

21. An inkjet head comprising:

a channel plate in which an ink channel is formed, the ink channel including:

an ink inlet to receive ink from an external source, a plurality of reservoirs to store ink received through the ink inlet, a plurality of chambers filled with ink supplied from respective ones of the reservoirs, a plurality of nozzles to eject ink filled in the respective chambers, and at least two restrictors disposed along each path of the nozzle, chamber, reservoir and ink inlet to control the amount of ink flowing from the ink inlet to each nozzle and from each nozzle to the ink inlet; and an actuator disposed above each one of the plurality of chambers to a ply a driving force to eject ink therefrom;

wherein the respective chambers and corresponding reservoirs are formed on different planes;

the at least two restrictors comprise:

a first restrictor disposed between the chamber and the reservoir, and a second restrictor disposed between the reservoir and the ink inlet; and each of the plurality of reservoirs comprises:

a first reservoir to receive ink from the first reservoir and transfer the received ink to the respective chamber, and a second reservoir to receive ink from the ink inlet.

22. The inkjet head of claim 21, wherein the at least two restrictors comprises:

a first restrictor disposed between the chamber and the first reservoir;

a second restrictor disposed between the first reservoir and the second reservoir; and a third restrictor disposed between the second reservoir and the ink inlet.

23. An inkjet head comprising:

a channel plate in which an ink channel is formed;

an actuator formed on the channel plate to apply a driving force to eject ink; and an ink-supply bezel coupled to a top surface of the channel plate and including a manifold from which ink is supplied to the ink channel, wherein the ink channel includes:

an ink inlet to receive ink from the manifold;

a plurality of reservoirs to store ink received through the ink inlet;

a plurality of chambers filled with ink supplied from the respective reservoirs;

a plurality of nozzles to eject ink filled in the respective chambers;

a plurality of first restrictors respectively connecting the reservoirs to the chambers; and a plurality of second restrictors respectively connecting the reservoirs to the ink inlet;

wherein each of the first and second restrictors has a T-shaped cross section.

24. An inkjet head comprising:

a channel plate in which an ink channel is formed;

an actuator formed on the channel plate to apply a driving force to eject ink; and an ink-supply bezel coupled to a top surface of the channel plate and including a manifold from which ink is supplied to the ink channel, wherein the ink channel includes:

an ink inlet to receive ink from the manifold;

a plurality of reservoirs to store ink received through the ink inlet;

a plurality of chambers filled with ink supplied from the respective reservoirs;

a plurality of nozzles to eject ink filled in the respective chambers;

a plurality of first restrictors respectively connecting the reservoirs to the chambers; and a plurality of second restrictors respectively connecting the reservoirs to the ink inlet;

wherein each of the reservoirs comprises a first reservoir and a second reservoir that are separated by a central separation wall, and the separation wall comprises a third restrictor connecting the first and second reservoirs.

25. An inkjet head comprising:

a channel plate in which an ink channel is formed;

an actuator formed on the channel plate to apply a driving force to eject ink; and an ink-supply bezel coupled to a top surface of the channel plate and including a manifold from which ink is supplied to the ink channel, wherein the ink channel includes:

an ink inlet to receive ink from the manifold;

a plurality of reservoirs to store ink received through the ink inlet;

a plurality of chambers filled with ink supplied from the respective reservoirs;

a plurality of nozzles to eject ink filled in the respective chambers;

a plurality of first restrictors respectively connecting the reservoirs to the chambers;

a plurality of second restrictors respectively connecting the reservoirs to the ink inlet;

flexible plates respectively formed on top portions of the reservoirs to absorb pressure waves transmitted to the reservoirs; and cavities formed on the flexible plates, respectively.

26. An inkjet head comprising:

a channel plate in which an ink channel is formed;

an actuator formed on the channel plate to apply a driving force to eject ink; and an ink-supply bezel coupled to a top surface of the channel plate and including a manifold from which ink is supplied to the ink channel, wherein the ink channel includes:

an ink inlet to receive ink from the manifold, a plurality of reservoirs to store ink received through the ink inlet;

a plurality of chambers filled with ink supplied from the respective reservoirs;

a plurality of nozzles to eject ink filled in the respective chambers;

a plurality of first restrictors respectively connecting the reservoirs to the chambers;

a plurality of second restrictors respectively connecting the reservoirs to the ink inlet;

flexible plates respectively formed on bottom portions of the reservoirs to absorb pressure waves transmitted to the reservoirs; and cavities formed under the flexible plates, respectively.

27. An inkjet head comprising:

a plurality of reservoirs to receive ink supplied to the inkjet head;

a plurality of ejection chambers to respectively receive the ink from the reservoirs; and a plurality of restrictors respectively formed at each end of the reservoirs;

wherein the reservoirs and corresponding ejection chambers are offset such that a flow of the ink changes direction moving from the reservoirs to the corresponding ejection chambers, and each of the restrictors has a T-shaped cross section.

* * * * *

UNITED STATES PATENT AND TRADEMARK OFFICE

CERTIFICATE OF CORRECTION

PATENT NO. : 7,789,494 B2
APPLICATION NO. : 11/767655
DATED : September 7, 2010
INVENTOR(S) : Young-ki Hong et al.

It is certified that error appears in the above-identified patent and that said Letters Patent is hereby corrected as shown below:

On the title page, item (73) Assignee: "Samsung Electronics Co., Ltd." should be changed to "Samsung Electro-Mechanics Co., Ltd."

Signed and Sealed this
Twenty-first Day of June, 2011

David J. Kappos

David J. Kappos
*Director of the United States Patent and Trademark Office*